US007250086B2

(12) United States Patent
Furber et al.

(10) Patent No.: US 7,250,086 B2
(45) Date of Patent: Jul. 31, 2007

(54) METHOD OF USING A SOLID RINSE ADDITIVE DISPENSER FOR DISPENSING A USE SOLUTION IN A DISHWASHING MACHINE

(75) Inventors: John P. Furber, St. Paul, MN (US); Yvonne M. Killeen, South St. Paul, MN (US)

(73) Assignee: Ecolab Inc., St. Paul, MN (US)

( * ) Notice: Subject to any disclaimer, the term of this patent is extended or adjusted under 35 U.S.C. 154(b) by 556 days.

(21) Appl. No.: 10/730,434

(22) Filed: Dec. 8, 2003

(65) Prior Publication Data

US 2005/0121058 A1 Jun. 9, 2005

(51) Int. Cl.
*B08B 3/03* (2006.01)

(52) U.S. Cl. ..... 134/18; 134/24; 134/25.4; 134/26; 134/36

(58) Field of Classification Search ..... 134/18, 134/24, 25.2, 26, 36, 57 D, 56 D, 58 D, 93; 68/17 R, 207; 422/261, 266, 279
See application file for complete search history.

(56) References Cited

U.S. PATENT DOCUMENTS 2,477,998 A 8/1949 McCowan
4,020,865 A * 5/1977 Moffat et al. ..... 137/268
4,181,702 A 1/1980 Watson
4,426,362 A 1/1984 Copeland et al.
4,438,534 A 3/1984 Keyes et al.
4,687,121 A 8/1987 Copeland
4,690,305 A 9/1987 Copeland
4,753,781 A * 6/1988 Cassady et al. ..... 422/264
4,790,981 A * 12/1988 Mayer et al. ..... 422/263
RE32,818 E 1/1989 Fernholz et al.
4,826,661 A 5/1989 Copeland et al.
4,938,240 A * 7/1990 Lakhan et al. ..... 134/93

(Continued)

FOREIGN PATENT DOCUMENTS

EP 0691099 1/1996

(Continued)

*Primary Examiner*—Frankie L. Stinson
(74) *Attorney, Agent, or Firm*—Andrew D. Sorensen; Anneliese S. Mayer

(57) ABSTRACT

A preferred embodiment method for dispensing a use solution from a solid product into a dishwashing machine includes placing a solid product in a dispenser. The product dispenser (10) for dispensing a use solution from a solid product includes a chamber (11) having a front (12), a back (15), and a bottom (16). The chamber (11) defines a cavity (20) configured and arranged to receive a solid product and a diluent. An inlet (21) proximate the back (15) of the chamber (11) is configured and arranged to receive the diluent, and an outlet portion (26) is in fluid communication with the inlet (21). The outlet portion (26) spans a length of the back (15) and includes a plurality of apertures (27) along the length of the back (15). The plurality of apertures (27) allows diluent to fan out along the back (15), flow down the back (15), and cascade evenly with relatively even pressure from proximate the back (15) toward proximate the front (12) of the chamber (11). A use solution outlet (32) proximate the bottom (16) and the front (12) of the chamber (11) allows diluent and a use solution to exit the chamber (11).

7 Claims, 5 Drawing Sheets

U.S. PATENT DOCUMENTS 5,007,559 A * 4/1991 Young ..... 222/1
5,133,487 A * 7/1992 Russi ..... 222/651
5,186,912 A 2/1993 Steindorf et al.
5,261,432 A * 11/1993 Sandrin ..... 134/93
5,262,132 A 11/1993 Bricker et al.
5,268,153 A 12/1993 Muller
5,282,901 A 2/1994 Reinhard
5,310,430 A 5/1994 McCall, Jr.
5,417,939 A * 5/1995 Bunschoten et al. ..... 422/264
5,427,748 A * 6/1995 Wiedrich et al. ..... 422/284
5,501,742 A 3/1996 Fernholz
5,759,501 A 6/1998 Livingston et al.
5,827,486 A 10/1998 Crossdale
6,007,788 A * 12/1999 Bellon et al. ..... 422/264
6,773,668 B1 8/2004 Everson et al.
2003/0168085 A1 9/2003 Sowle et al.

FOREIGN PATENT DOCUMENTS

GB 2226233 A 6/1990
WO WO 0025658 5/2000
WO WO 0178572 10/2001

* cited by examiner

METHOD OF USING A SOLID RINSE ADDITIVE DISPENSER FOR DISPENSING A USE SOLUTION IN A DISHWASHING MACHINE

BACKGROUND OF THE INVENTION

1. Field of the Invention

The present invention relates to a solid product dispenser, and more specifically, the present invention relates to a solid rinse additive for use with a dishwashing machine.

2. Description of the Prior Art

Solid products are commonly dissolved with a diluent to form a liquid use solution prior to use. Generally, spray-type dispensers for dispensing various products function by impinging a liquid spray upon an exposed surface of a solid product to dissolve a portion of the product thereby creating a use solution. Flood-type dispensers function by filling a cavity of a dispenser containing a solid product with a liquid, and the liquid dissolves a portion of the solid product as the liquid contacts the solid product. Then, the use solution comprising the dissolved product is directed out of the dispenser to a storage reservoir or to a point of use.

Spray-type dispensers tend to unevenly erode the solid product, which makes the concentration of the use solution unpredictable. Flood-type dispensers may, in some circumstances, dissolve too much product when a lesser concentration is desired. The present invention provides a dispenser for dispensing a solid product when a lower concentration is desired without unevenly eroding the solid product.

One instance where a lower concentration of product may be desired is in dispensing rinse additives in dishwashing machines. Peristaltic pumps are typically used for dispensing liquid rinse additives.

SUMMARY OF THE INVENTION

A preferred embodiment method for dispensing a use solution from a solid product into a dishwashing machine includes placing a solid product in a dispenser, the dispenser having a chamber including a front, a back, and a bottom. The chamber defines a cavity configured and arranged to receive the solid product and water from a water source, and the chamber includes a water inlet proximate the back and a use solution outlet proximate the bottom and the front. The water inlet receives the water from the water source. Water is concurrently supplied from the water source to rinse arms of a dishwashing machine and the water inlet. The water fans out along the back, flows down the back, and cascades evenly with relatively even pressure from proximate the back, toward proximate the front, and out the use solution outlet. A use solution is created as water contacts a bottom portion of the solid product as the water cascades toward proximate the front of the chamber. Substantially all of the use solution and the water is allowed to exit the cavity through the use solution outlet, and the use solution is directed into the dishwashing machine.

A preferred embodiment product dispenser for dispensing a use solution from a solid product includes a chamber having a front, a back, and a bottom. The chamber defines a cavity configured and arranged to receive a solid product and a diluent. An inlet proximate the back of the chamber is configured and arranged to receive the diluent, and an outlet portion is in fluid communication with the inlet. The outlet portion spans a length of the back and includes a plurality of apertures along the length of the back. The plurality of apertures allows diluent to fan out along the back, flow down the back, and cascade evenly with relatively even pressure from proximate the back toward proximate the front of the chamber. A use solution outlet proximate the bottom and the front of the chamber allows diluent and a use solution to exit the chamber.

A preferred embodiment solid product dispensing system for dispensing a use solution into a dishwashing machine includes a solid product having a bottom portion, a water source including water, and a chamber. The chamber has a front, a back, and a bottom and defines a cavity configured and arranged to receive the solid product and the water from the water source. A support member in the cavity proximate the bottom of the chamber supports the solid product within the cavity, and water flows through the support member to contact the solid product. A water inlet proximate the back of the chamber is configured and arranged to receive the water from the water source. An outlet portion is in fluid communication with said water inlet, and the outlet portion spans a length of the back and includes a plurality of apertures along the length of the back. The plurality of apertures allows water to fan out along the back, flow down the back, and cascade evenly with relatively even pressure from proximate the back toward proximate the front of the chamber. A use solution outlet proximate the bottom and the front of the chamber allows water and a use solution to exit the chamber, allowing substantially all the water and the use solution to exit the chamber.

DETAILED DESCRIPTION OF A PREFERRED EMBODIMENT

Figure 1:
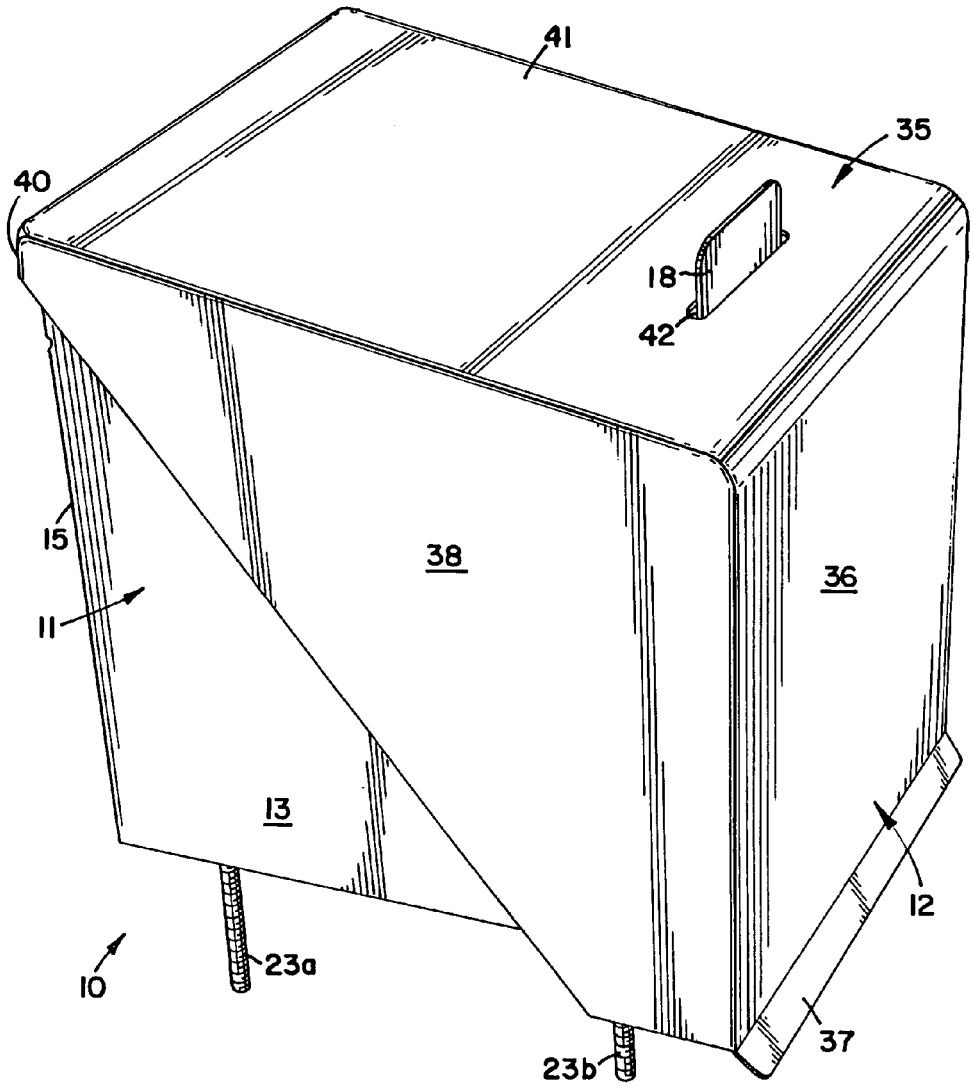
FIG. 1 is a front perspective view of a dispenser constructed according to the principles of the present invention.

A preferred embodiment dispenser constructed according to the principles of the present invention is designated by the numeral 10 in the drawings.

Referring to FIGS. 1-3 and 6, the preferred embodiment dispenser 10 includes a chamber 11 and a lid 35. The chamber 11 includes a front 12, a first side 13, a second side 14, a back 15, a bottom 16, and a top 17. The preferred orientation of the dispenser 10 as described herein is determined by viewing the front 12 of the dispenser 10 with the back 15 of the dispenser 10 facing the mounting surface. The front 12 and the back 15 are interconnected on the respective left edges by the first side 13 and on the respective right edges by the second side 14. The bottom 16 encloses the dispenser 10 along the bottom edges of the front 12, the first side 13, the second side 14, and the back 15 while the top 17 is formed by the top edges of the front 12, the first side 13, the second side 14, and the back 15. The bottom 16 is preferably tilted slightly toward the front 12 of the dispenser 10 so that the back of the bottom 16 is slightly higher than the front of the bottom 16. The top 17 provides an opening 19 into a cavity 20 within the dispenser 10 formed by the chamber 11. The top 17 includes a top portion 17*a*, which is a narrow, rectangular shaped portion connected to the top edge of the back 15 and interconnecting the top edges of the first side 13 and the second side 14 proximate the back 15. The top portion 17*a* does not extend along the entire top 17 of the dispenser 10 and only covers a relatively small segment of the top 17. Therefore, the top portion 17*a* does not enclose the top 17 of the chamber 11, thus leaving opening 19 into the cavity 20. The front 12 may include a tab 18 extending upward from the top 17. A hinge 44 is located proximate the back 15 and the top 17 and is preferably operatively connected thereto by screws 45. The hinge 44 interconnects the chamber 11 and the lid 35, which provides a cover for the opening 19 and the cavity 20. Although the preferred embodiment dispenser 10 is shown and described as having a square-like shape, it is recognized that any suitable shape and size may be used. It is also recognized that other suitable types of covers may be used for the opening 19 and the cavity 20.

Figure 6:
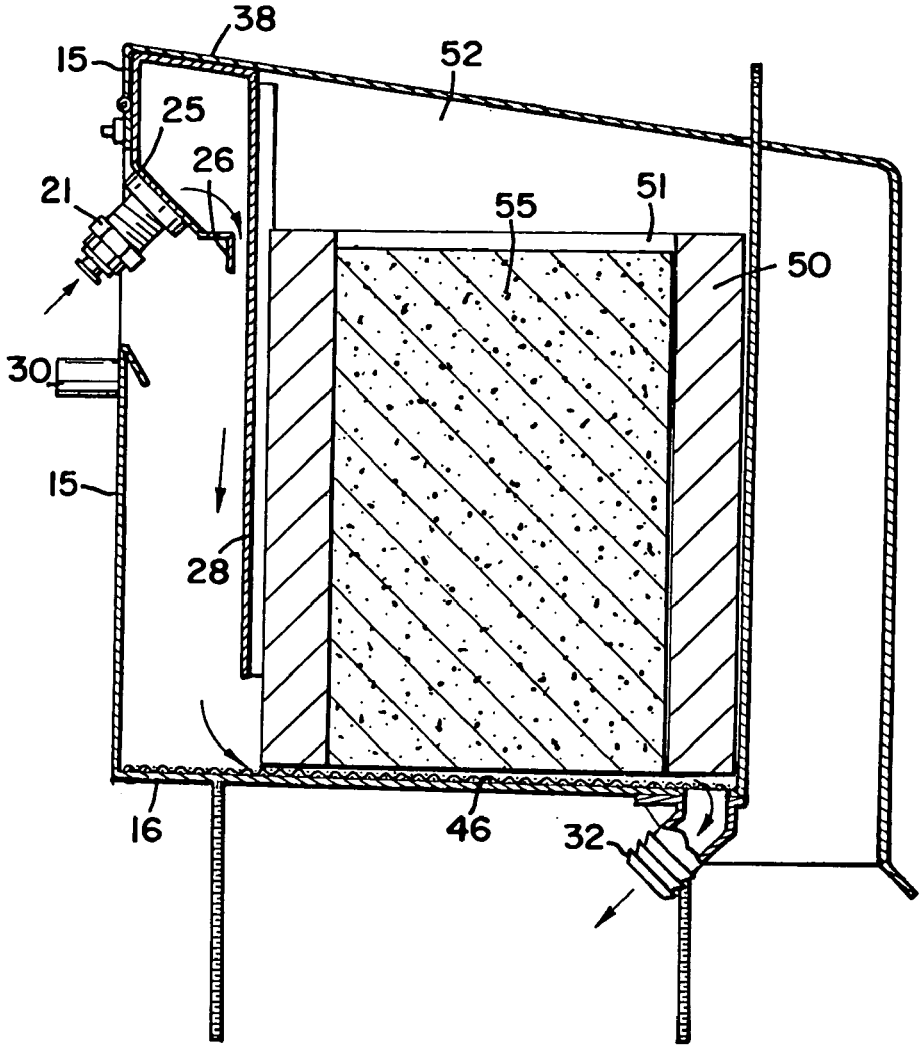
FIG. 6 is a side partial cross-sectional view of the dispenser shown in FIG. 1.
Figures 7A, 7B:
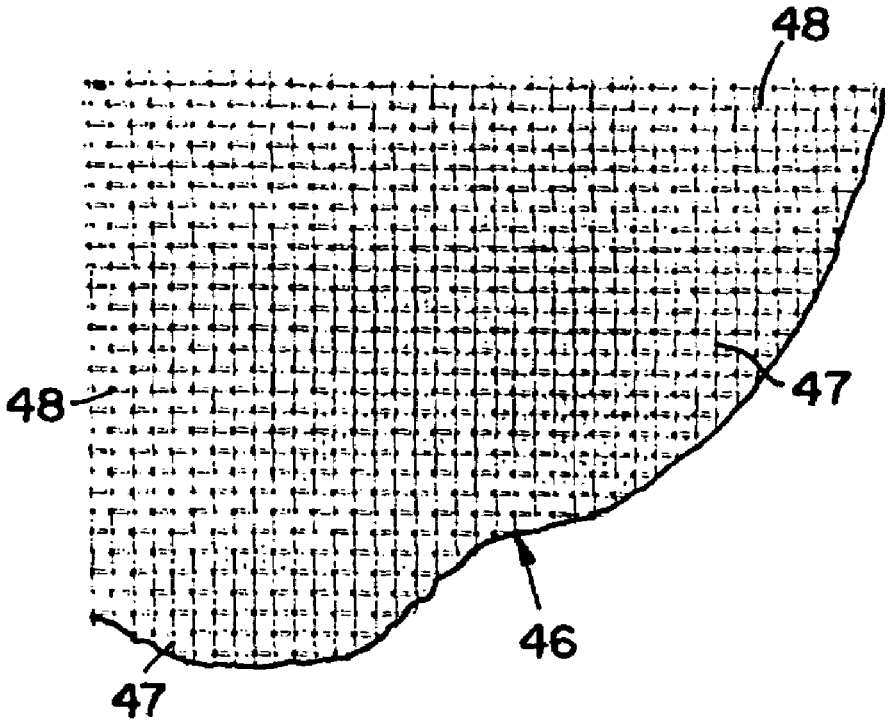
FIG. 7A is a top view of a support member for use with the dispenser shown in FIG. 1.
FIG. 7B is a side view of the support member shown in FIG. 7A.

The cavity 20, defined by the chamber 11, is accessible though the opening 19 and is configured and arranged to receive a solid product (not shown) such as solid rinse additive for and water from a water source. The solid product could be in the shape of a block, pellets, granules, or any other suitable shape known in the art. In the preferred embodiment, a block shape is used, and the block shape may be any shape such as oval, cylindrical, square, etc. Within cavity 20, the solid product rests upon a support member 46, shown in FIGS. 3, 6, 7A, and 7B, which extends across the cavity 20 proximate the bottom 16. The support member 46 is preferably a screen-type structure that supports the solid product proximate the bottom 16 and allows water to pass through to contact and dissolve a portion of the solid product. Preferably, as shown in FIGS. 7A and 7B the filaments 47 of the support member 46 are woven together such that there are passageways through which the water may flow, albeit through somewhat of a tortured path, to contact the bottom of the solid product. More even erosion of the solid product occurs since water contacts the bottom of the solid product rather than flowing around the solid product. In addition, a greater surface area is exposed to the water by using the support member 46. Between cycles, the support member 46 may also hold some of the water within some of the apertures 48 between the filaments 47 via capillary action, which may also contact the solid product thereby continuing to dissolve a portion of the solid product for use in the next cycle. Using a smaller mesh or a larger mesh for the support member 46 can vary the amount of water held within the apertures 48 to assist in dispensing the desired amount of product. A smaller mesh will hold more water while a larger mesh will hold less water.

Figure 2:
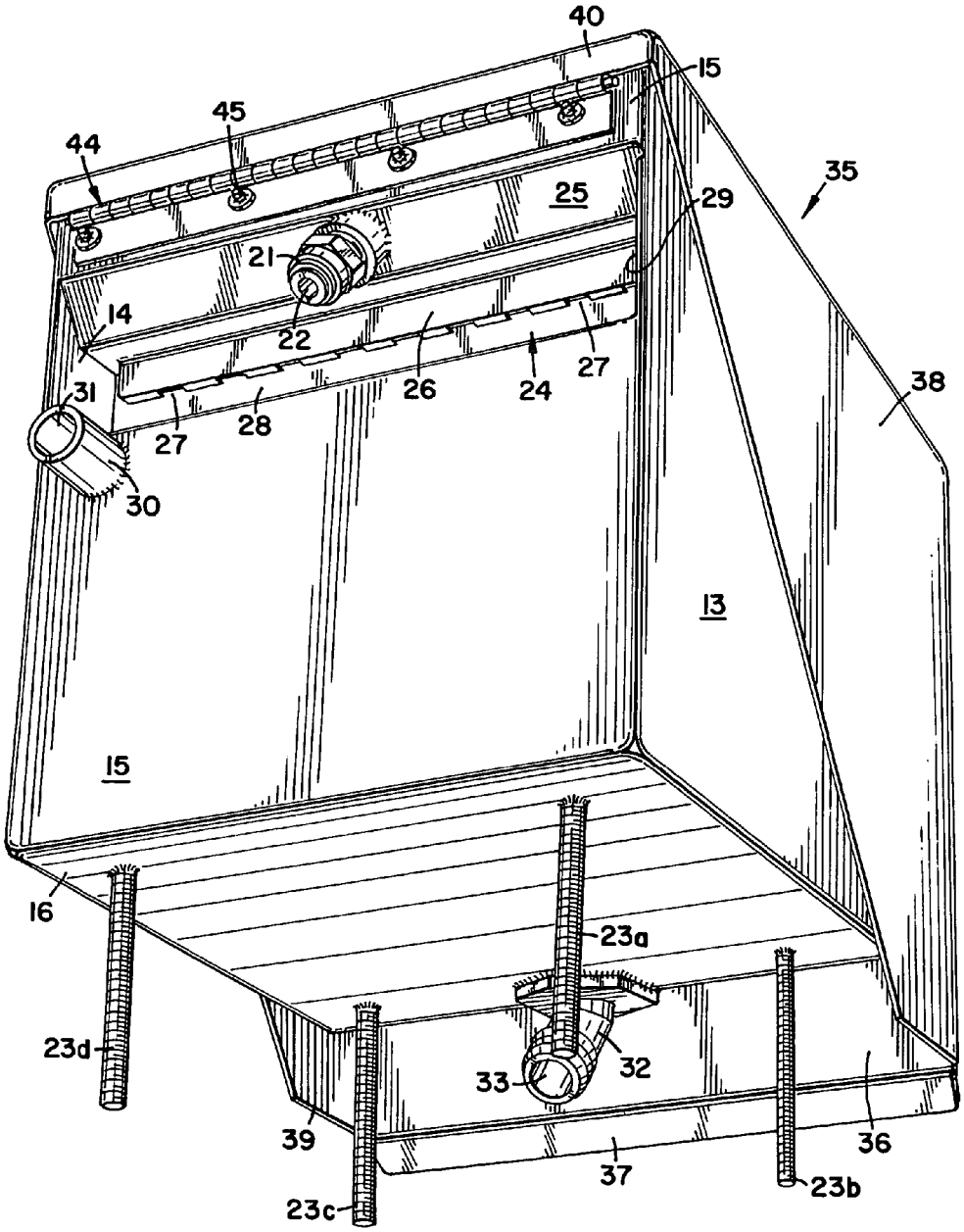
FIG. 2 is a rear perspective view of the dispenser shown in FIG. 1.
Figure 3:
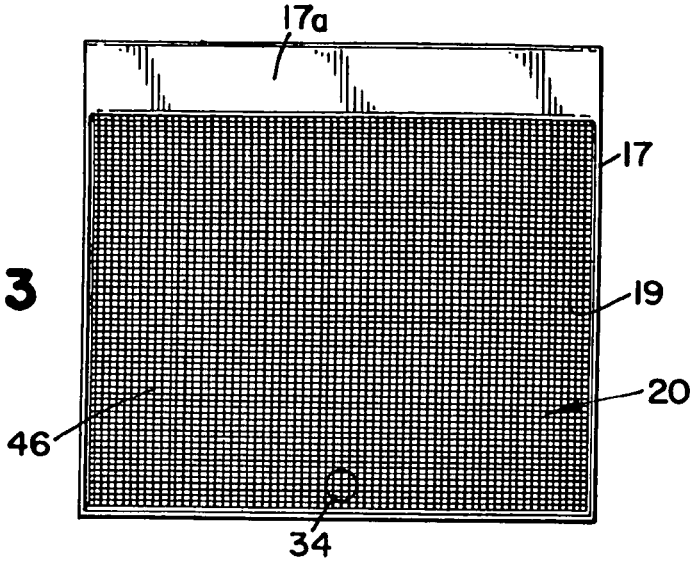
FIG. 3 is a top view of the dispenser shown in FIG. 1.

The back 15 of the chamber 11 includes an opening 29 proximate the top and the middle of the back 15. As shown in FIGS. 2 and 6, the opening 29 reveals a second back 28 positioned within the cavity 20 proximate the front edge of the top portion 17*a*. The second back 28 extends downward parallel with the back 15 but does not extend fully to the bottom 16. The back 15 and the second back 28 are operatively connected with an angled portion 25 and an outlet portion 26, which span across a majority of the length of the back 15 and the second back 28. Preferably, the angled portion 25 and the outlet portion 26 span the entire length of the back 15 and the second back 28. The angled portion 25 extends from the back 15 proximate the top of the opening 29 at a downward angle toward the second back 28 where it meets the outlet portion 26. There is a space between the angled portion 25 and the second back 28. The outlet portion 26 interconnects the angled portion 25 and the second back 28. The outlet portion 26 is a planar member extending downward parallel with the second back 28 and including tabs bent at approximately a 90° angle to operatively connect to the second back 28. The tabs are preferably distributed evenly along the outlet portion 26 and define a plurality of apertures 27 preferably distributed evenly along the length of the second back 28. More preferably, at least approximately 50% of the outlet portion 26 defines the plurality of apertures 27, which are preferably evenly and proportionately distributed along the length of the second back 28. It is recognized that any suitable arrangement and proportion of apertures 27 may be used as long as water enters the cavity 20 evenly along the length of the cavity 20 with relatively even pressure.

A water inlet 21 having an opening 22 is located proximate the center of the angled portion 25 where the dispenser 10 receives a diluent, preferably water from a water source. The space between the back 15 and the second back 28 and the space between the apertures 27 and the bottom 16 create a natural air gap 24 in the dispenser 10. In addition, the back 15 includes an overflow outlet 30 having an opening 31 proximate the bottom of the opening 29. The overflow outlet 30 preferably has a diameter of approximately 0.50 inches and allows excess water within cavity 20 of chamber 11 to readily escape in the event too much water flows into cavity 20 rather than having the excess water or use solution spill out from the top 17 of the dispenser 10.

The bottom 16 includes an opening 34 with which a use solution outlet 32 having an opening 33 is in fluid communication. Preferably, the use solution outlet 32 is located proximate the front of the dispenser and preferably has a diameter of approximately 0.50 inches. The use solution outlet 32 is preferably always open and, because water flows from proximate the back 15 toward proximate the front 12 by gravity and because the bottom 16 is slightly tilted toward the front 12, substantially all of the water and the use solution in the cavity 20 are dispensed through the use solution outlet 32. It is recognized, however, that some water may be held within the apertures 48 of the support member 46 via capillary action. Therefore, little to no water and/or use solution remains in contact with the solid product when no water is flowing into the cavity 20 and the dispenser 10 is not in use.

The rate of water flowing into the cavity 20 should be approximately the same as the rate of water and use solution flowing out of the cavity 20. In the preferred embodiment, when used with a rinse additive, which requires less water flow, the rate of water flowing into the cavity 20 is preferably approximately 50 to 150 milliliters per minute, and the rate of water and use solution flowing out of the cavity 20 is preferably approximately 50 to 150 milliliters per minute. The rate of water flowing into the cavity 20 depends upon several factors including the diameter and the length of the tubing interconnecting the water supply and the water inlet 21, the amount of pressure in the water supply, and the valve setting. Although it is unlikely that the solid product would flow out of cavity 20 along with the use solution, it is possible if a pellet or granular product is used, especially if the overflow outlet 30 is used. Therefore, a screen or sieve type member known in the art may be used to prevent solid product from flowing out of the cavity 20 along with the water and the use solution. The support member 46 may be used to serve this function.

As shown in the preferred embodiment, the bottom 16 of the dispenser 10 may also include a first leg 23*a*, a second leg 23*b*, a third leg 23*c*, and a fourth leg 23*d* operatively connected proximate each corner of the bottom 16. The legs 23*a-d* may support the dispenser 10 upon a surface or the surface may include holes through which the legs 23*a-d* may be inserted. If the legs 23*a-d* are threaded, as shown, and inserted through holes in the surface, bolts (not shown) may be used to secure the dispenser 10 onto the surface as long as there is adequate room for the use solution outlet 32 between the bottom 16 and the surface. Alternatively, the dispenser 10 may include a mounting bracket to mount the dispenser 10 onto a surface.

The lid 35 covers opening 19 of cavity 20 and may include a front 36 having a flange 37, a first side 38, a second side 39, a back 40, and a top 41 having an opening 42. The front 36 and the back 40 are interconnected on the respective left edges by the first side 38, and the front 36 and the back 40 are interconnected on the respective right edges by the second side 39. The top 41 interconnects the top edges of the front 36, the first side 38, the second side 39, and the back 40. The flange 37 extends outward at a slight angle from the bottom edge of the front 36 to provide a surface upon which the lid 35 may be lifted and lowered as the lid 35 pivots at the hinge 44. Sides 38 and 39 are wider proximate the top 41 and taper toward the front 36. The optional tab 18 of the chamber 11 is configured and arranged to extend through the opening 42 to provide indication when a low level of solid product is contained within the cavity 20. When the level of solid product contained within the cavity 20 is low, the tab 18 extends through the opening 42. A label displaying the word "low" or some other word or phrase may be placed on the tab 18 to indicate when more product should be added. If this feature is used, the lid 35 does not contact the chamber 11 proximate the front of the dispenser initially, and as the product is dispensed, the lid 35 gradually lowers and the tab 18 gradually begins to protrude through opening 42 to indicate when solid product should be added. This feature is optional and may not be as useful for some types of solid products as it may be for others. As stated previously, it is recognized that other suitable types of covers may be used for the opening 19 and the cavity 20 rather than the lid 35 as shown and described herein.

Figure 4:
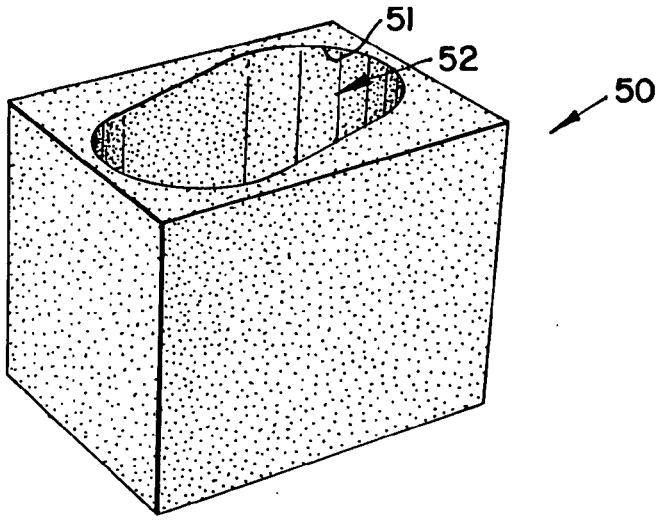
FIG. 4 is a front perspective view of an insert for use with the dispenser shown in FIG. 1.
Figure 5:
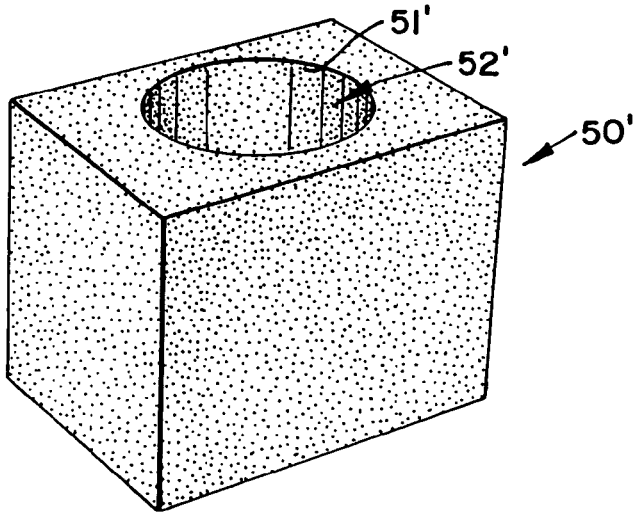
FIG. 5 is a front perspective view of another insert for use with the dispenser shown in FIG. 1.

Referring to FIGS. 4 and 5, the dispenser may also include an insert block member 50 or 50', respectively, which acts as a lock-out feature. Insert block member 50 has an oval opening 51, which provides access to cavity 52. Insert block member 50' has a round opening 51', which provides access to cavity 52'. It is recognized that the insert block member may have a cavity and an opening thereto of any shape, and the solid product may be configured and arranged to fit within the cavity thereby creating a lock-out for solid products not similarly shaped. This may be used to ensure the proper products are used with the dispenser.

In operation, the present invention may be used concurrently with the rinse cycle of the dishwashing machine (not shown). No complicated mechanical or electrical devices are required to operate the dispenser 10 because the dispenser 10 works with the rinse cycle of the dishwashing machine. In a dishwashing machine, a fresh water rinse at the end of the wash cycle washes away any remaining dirty wash water and debris. In most commercial applications, a rinse additive is used in conjunction with the fresh water rinse to improve the sheeting properties of the rinse water, helping to eliminate spotting on the glassware and to reduce drying time. Rinse additives that are manufactured in a solid form must first be converted to a liquid form before used in a dishwashing machine. Traditionally, a dispenser uses a water spray to dissolve the solid into a use solution, and the use solution is stored in a sump from which it is pumped into the water rinse line when needed. This manner of managing and controlling the use of rinse additives can involve complex and expensive dispensing equipment. The present invention eliminates the need for a pump or any other complex mechanical device because the rinse additive solution drains by gravity to the dishwashing machine when needed.

Rinse arms (not shown) receive water from a water source, and water from the water source is also concurrently diverted to the water inlet 21 of the dispenser 10 at the beginning of the rinse cycle. Preferably, the water has a temperature of approximately 180° F. or higher if used with a high temperature dishwashing machine and flows at a pressure of approximately 20 psi. As water enters the opening 22 of the water inlet 21, water enters the space between the angled portion 25 and the second back 28, fans out within the space, and then exits through the plurality of apertures 27 in the outlet portion 26. Because the plurality of apertures 27 is distributed evenly along the outlet portion 26, the water is dispensed from the plurality of apertures 27 evenly along the back 15 with relatively even pressure. The water then flows downward within the space between the back 15 and the second back 28 toward the bottom 16. Because the second back 28 does not extend fully to the bottom 16, the water enters the cavity 20 proximate the bottom 16 and where the second back 28 ends. Therefore, water flows evenly across the second back 28 into the bottom 16 along the second back 28. Because water enters the cavity 20 evenly along the length of the cavity 20 with relatively even pressure, erosion of the solid product will occur more consistently and evenly.

As water enters the cavity 20, the water reaches the support member 46 and flows through the support member 46 to contact a bottom portion of the solid product, which is supported by the support member 46. The support member 46 is permeable to the water, which readily flows through the support member 46. Preferably, the water level within the cavity 20 does not rise much higher than the support member 46 so as to simply skim the bottom portion of the solid product as water cascades from the back 15 to the front 12 of the dispenser. Most preferably, the water skims the bottom surface of the solid product. A small portion of the solid product dissolves into the water thereby creating a concentrated use solution as the water cascades across the bottom portion of the solid product. In the preferred embodiment, approximately 0.50 grams of solid rinse additive is dissolved during each cycle. The use solution exits the cavity 20 through the use solution outlet 32 by way of a gravity drain. The solid product does not "soak" in water. Although the use solution outlet 32 is always open, water skims the solid product as it enters the cavity 20 proximate the back 15 of the dispenser and exits the cavity 20 proximate the front 12 of the dispenser via the use solution outlet 32. There is neither flooding of water within the cavity 20 nor siphoning of water into the cavity 20. The concentrated use solution is then directed to the dishwashing machine tank. The water flow within the dispenser 10 is shown by an arrow in FIG. 6.

Water inlet 21 is configured and arranged to receive water from a water source, preferably via a conduit (not shown). Adjusting the amount of water flow into the dispenser would help to control the dispensing rate of the product 55 as the water level within cavity 20 is important to ensure the correct concentration of solid product 55 is being dispensed, and the concentration of the use solution can be controlled by allowing more or less water into the cavity 20. A pressure reducing valve, a meter valve, a needle valve, or other suitable type of flow limiting device known in the art could be used to regulate the amount of water flowing from the water source into the cavity 20 via water inlet 21. A valve may not be needed if the dishwashing machine has a solenoid valve controlling the input of the rinse water (e.g. Hobart AM Series). Also, different solid products may require different concentrations, which may be adjusted by using a valve.

In the preferred embodiment, chamber 11 is filled with water from the bottom 16 and the water level increases slightly as water flows evenly along the back 15 and into the bottom of the cavity 20 from the bottom of the space between the back 15 and the second back 28. Water enters the cavity 20 proximate the support member 46 and as water enters the cavity 20 the water contacts the solid product 55 proximate a bottom portion of the solid product 55 to create a concentrated use solution. Filling the cavity 20 from the bottom with even pressure along the back 15 of the dispenser minimizes the vortices and the eddies, which tend to erode products unevenly thereby dispensing an unpredictable concentration of product. Less turbulence and more even distribution of the water as it enters the cavity 20 reduces the likelihood of eroding the products unevenly. In addition, use of the present invention results in more uniform dissolution of the product 55 and a more constant concentration and shape of the product 55 is maintained. Uniform erosion of the product 55 is important because there is a linear relationship between the surface area of the product 55 exposed to the water and the number of grams of product 55 dispensed. Therefore, if the shape of the product 55 remains relatively constant, the surface area of the solid product 55 will remain relatively constant and the exposure to water will keep the solid product 55 dispensing rate relatively constant over time.

As cavity 20 is supplied with water from the bottom of chamber 11 to a level proximate the support member 46, water contacts the bottom of the solid product 55 and dissolves a portion of the solid product 55 thereby creating a use solution. In the preferred embodiment, water contacts the solid product 55 by merely skimming the bottom of the solid product. In other words, water cascades evenly with relatively even pressure across the back 15, along the bottom of the solid product, and toward proximate the front 12 of the dispenser to create a use solution, which exits the use solution outlet 32. Only a relatively small amount of solid product 55 is dissolved each time water fills the cavity 20 and contacts the solid product. The cavity 20 is not flooded with water and the solid product 55 is only contacted with water while the water is being supplied to the cavity 20. As the water enters the cavity 20 proximate the back 15, the water skims the bottom of the solid products thereby forming a use solution, which exits the cavity 20 via the use solution outlet 32. The use solution outlet 32 is configured and arranged to allow substantially all of the water and the use solution to flow out of the cavity 20 and into the dishwashing machine. After water is no longer being supplied to the cavity 20, substantially all of the water and the use solution drain out of the cavity 20 via the use solution outlet 32. Substantially all means that enough of the water and the use solution have been dispensed so that the water and the use solution are not in contact with the solid product. However, if the cavity 20 becomes flooded with water and/or use solution, excess water and/or use solution will exit the dispenser 10 via the overflow outlet 30. The overflow may be directed to flow into a drain pan of the dishwashing machine and then into the sewer.

In the preferred embodiment, only a relatively small amount of solid product 55 is dissolved each time water enters the cavity 20. As water skims the bottom of the product, a small amount of product 55 is dissolved from the bottom. Therefore, a uniform erosion pattern of the product 55 occurs when it is dissolved in water to ensure the right concentration of product 55 is used. Uniform erosion is important because there is a linear relationship between the surface area exposed and the number of grams of product 55 dispensed. If the shape of the product 55 remains relatively constant, the surface area of the product 55 will remain relatively constant and the dispensing rate will remain relatively constant. Although the rate of dissolution may be affected by several variables such as but not limited to the amount of water used, the time of exposure to water, and the temperature of the water, these variables should not affect the erosion pattern too greatly in the present invention.

The present invention could be used concurrently with the OMEGA detergent dispenser by Ecolab Inc., which is described in U.S. patent application Ser. No. 09/550,428 and incorporated by reference herein. The present invention could also be used with detergents, sanitizers, presoak products, and other dishwashing products. In addition, it could also be used with manual dishwashing products or any number of other products that must be converted from a solid to a liquid prior to use.

EXAMPLE 1

A test was conducted to determine the dispensing rates of a solid rinse additive, DRY FUSION by Ecolab Inc., when different amounts of water were added to the dispenser. Water was added about every 90 seconds, and the water was approximately 120° F. Dispensing rates for the solid rinse additive were determined by calculating the concentration of rinse additive in the use solution dispensed from the use solution outlet of the dispenser. A dye used in the rinse additive absorbs at 620 nanometers, and a UV/vis spectrophotometer was used to determine the dispensing rates. The results shown in Table 1 indicate that the dispensing rate of the product can be controlled by controlling the volume of water used in the dispenser during each cycle.

TABLE 1

Dispensing Rates of DRY FUSION When Water is Added at Different Rates

| Amount of Water (ml) | Beginning Absorption | Average Absorption | Ending Absorption | PPM | PPM in 1.7 gallons | PPM Actives in 1.7 gallons |
|---|---|---|---|---|---|---|
| 100 | 0.074 | 0.057 | 0.056 | 1338 | 20 | 11 |
| 185 | 0.081 | 0.056 | 0.056 | 1314 | 38 | 22 |
| 250 | 0.046 | 0.055 | 0.047 | 1291 | 50 | 29 |

EXAMPLE 2

A test was conducted to determine the dispensing rates of a solid rinse additive, DRY FUSION by Ecolab Inc., as the solid rinse additive was dispensed over time. The support member and the insert block member were used with the dispenser. 120 milliliters of water at 120° F. was added to the dispenser for 7 second cycles, with 60 seconds between each cycle, for 2 days. The solid rinse additive was dispensed at a rate to yield approximately 32 to 62 ppm actives (surfactants) in the use solution in the dishwashing machine wash-tank. A 57% active solid rinse additive was used in this example, but it is recognized that any percentage active solid rinse additive may be used and the dispenser may be adjusted to achieve the desired dispensing rate to yield approximately 32 to 62 ppm actives in the use solution in the dishwashing machine washtank. The beginning weight of the rinse additive was 449.17 grams and the ending weight of the rinse additive was 51.79 grams. The results are shown in Table 2. 397.4 grams of product were dispensed over 611 cycles. An average of 0.65 grams of product were dispensed per cycle or 101 ppm, 58 ppm actives. The results shown in Table 2 indicate that the solid rinse additive was relatively evenly dispensed over time.

TABLE 2

Dispensing Rates of DRY FUSION Over Time

| Cycle | Absorption | PPM | PPM in 1.7 gallons | PPM Actives in 1.7 gallons |
|---|---|---|---|---|
| 1 | 0.163 | 3660 | 68 | 39 |
| 88 | 0.227 | 5089 | 95 | 54 |
| 119 | 0.365 | 8172 | 152 | 87 |
| 209 | 0.320 | 7167 | 134 | 76 |
| 245 | 0.336 | 7524 | 140 | 80 |
| 260 | 0.299 | 6698 | 125 | 71 |
| 303 | 0.422 | 9445 | 176 | 100 |
| 372 | 0.155 | 3457 | 64 | 37 |
| 439 | 0.112 | 2503 | 47 | 27 |
| 502 | 0.174 | 3879 | 72 | 41 |
| 529 | 0.328 | 7298 | 136 | 78 |
| 558 | 0.287 | 6388 | 119 | 68 |
| 577 | 0.287 | 6388 | 119 | 68 |
| 611 | 0.283 | 6299 | 117 | 67 |
| Average | 0.270 | 5998 | 112 | 64 |
| Std. Deviation | | | 37.41648 | 21.32739 |

The above specification, examples and data provide a complete description of the manufacture and use of the composition of the invention. Since many embodiments of the invention can be made without departing from the spirit and scope of the invention, the invention resides in the claims hereinafter appended.

We claim:

1. A method for dispensing a use solution from a solid product into a dishwashing machine, comprising:

a) placing a solid product in a dispenser, said dispenser having a chamber including a front, a back, and a bottom, said chamber defining a cavity configured and arranged to receive said solid product and water from a water source, said chamber including a water inlet proximate said back and a use solution outlet proximate said bottom and said front, said water inlet receiving said water from said water source;

b) concurrently supplying water from said water source to both (i) rinse arms of a dishwashing machine and (ii) said water inlet, said water fanning out along said back, flowing down said back, and cascading evenly with relatively even pressure from proximate said back, toward proximate said front, and out said use solution outlet;

c) creating a use solution as water contacts a bottom portion of said solid product as said water cascades toward proximate said front of said chamber;

d) allowing substantially all of said use solution and said water to exit said cavity through said use solution outlet in such a way that the water skims the bottom of the solid product; and e) directing said use solution into said dishwashing machine via gravity.

2. The method of claim 1, further comprising placing a support member in said cavity proximate said bottom of said chamber, said solid product being supported by said support member, said water flowing through said support member to contact said solid product.

3. The method of claim 2, further comprising inserting an insert member configured and arranged to contain said solid product into said cavity, said insert member including an opening having a desired shape, said solid product being configured to fit within the opening.

4. The method of claim 1, further comprising directing water from said water inlet to a plurality of apertures along a length of said back, said plurality of apertures allowing said water to be dispensed evenly along said length of said back with relatively even pressure.

5. The method of claim 1, wherein said solid product is a rinse additive.

6. The method of claim 5, wherein said rinse additive is dispensed at a rate to yield approximately 32 to 62 ppm actives in said use solution in said dishwashing machine.

7. The method of claim 1, wherein uniform dissolution of said solid product occurs thereby maintaining a relatively constant concentration and a relatively constant shape of said solid product.

* * * * *